US009677513B2

(12) United States Patent
Wilson et al.

(10) Patent No.: US 9,677,513 B2
(45) Date of Patent: Jun. 13, 2017

(54) MECHANICALLY INDUCED VACUUM DRIVEN DELIVERY SYSTEM PROVIDING PRE-VAPORIZED FUEL TO AN INTERNAL COMBUSTION ENGINE

(71) Applicants: David L. Wilson, Mt. Pleasant, MI (US); Scott Machuta, Mt. Pleasant, MI (US)

(72) Inventors: David L. Wilson, Mt. Pleasant, MI (US); Scott Machuta, Mt. Pleasant, MI (US)

( * ) Notice: Subject to any disclaimer, the term of this patent is extended or adjusted under 35 U.S.C. 154(b) by 389 days.

(21) Appl. No.: 14/325,656

(22) Filed: Jul. 8, 2014

(65) Prior Publication Data

US 2016/0010592 A1 Jan. 14, 2016

(51) Int. Cl.

| | |
|---|---|
| ***F02M 27/02*** | (2006.01) |
| ***F02M 27/04*** | (2006.01) |
| ***F02M 37/00*** | (2006.01) |
| *F02M 37/02* | (2006.01) |

(52) U.S. Cl.

CPC ..... *F02M 27/02* (2013.01); *F02M 27/04* (2013.01); *F02M 37/0011* (2013.01); *F02M 37/02* (2013.01)

(58) Field of Classification Search

CPC ..... F02M 17/02; F02M 27/02; F02M 27/04; F02M 27/045; F02M 2027/047; F02M 37/0011; F02M 37/02

See application file for complete search history.

(56) References Cited

U.S. PATENT DOCUMENTS

| | | | | |
|---|---|---|---|---|
| 3,973,390 | A | 8/1976 | Jeroszko | |
| 5,298,126 | A * | 3/1994 | Dahl | D21F 1/02 162/339 |
| H1466 | H | 8/1995 | Stapf | |
| 5,649,517 | A | 7/1997 | Poola et al. | |
| 5,672,187 | A | 9/1997 | Rock et al. | |
| 5,746,188 | A | 5/1998 | Cooke | |
| 5,871,000 | A | 2/1999 | Ratner | |
| 5,881,702 | A | 3/1999 | Arkfeld | |
| 6,026,787 | A | 2/2000 | Sun et al. | |
| 6,045,772 | A | 4/2000 | Szydlowski | |
| 6,174,160 | B1 | 1/2001 | Lee et al. | |
| 6,189,518 | B1 | 2/2001 | Cooke | |
| 6,314,919 | B1 | 11/2001 | Pugachev | |
| 6,327,860 | B1 | 12/2001 | Critchley | |
| 6,539,721 | B2 | 4/2003 | Oikawa et al. | |
| 6,769,421 | B2 | 8/2004 | Newhouse et al. | |
| 6,968,692 | B2 | 11/2005 | Chin et al. | |
| 7,980,230 | B2 | 7/2011 | Smart | |
| 8,020,537 | B2 | 9/2011 | Smart | |
| 8,074,895 | B2 | 12/2011 | Mao et al. | |
| 8,266,911 | B2 | 9/2012 | Evulet | |
| 8,464,694 | B2 | 6/2013 | Gurin et al. | |
| 8,495,990 | B1 | 7/2013 | Rivera et al. | |
| 8,794,217 | B1 * | 8/2014 | Hill | F01N 3/00 123/536 |

* cited by examiner

*Primary Examiner* — Jacob Amick

(57) ABSTRACT

A mechanically induced vacuum driven delivery system for providing pre-vaporized fuel to an internal combustion engine, the major benefit being that fuel can be precisely controlled.

1 Claim, 3 Drawing Sheets

MECHANICALLY INDUCED VACUUM DRIVEN DELIVERY SYSTEM PROVIDING PRE-VAPORIZED FUEL TO AN INTERNAL COMBUSTION ENGINE

BACKGROUND OF THE INVENTION

What is disclosed and claimed herein is a mechanically induced vacuum driven delivery system for providing pre-vaporized fuel to an internal combustion engine, the major benefit being that fuel can be precisely controlled.

There are many prior art patents in this field, among them, one can find U.S. Pat. No. 3,973,390 issued on Aug. 10, 1976 to Jeroszko, which deals with a low emission combustion chamber in which a premixed fuel rich-air mixture is discharged uniformly into hot products of combustion of a pilot combustion zone to be vaporized. Combustion air is added.

U.S. Statutory Invention Registration H1466 that published Aug. 1, 1995 to Stapf, discloses an oxygen injection system. The engine flushes fuel to stabilize the catalyst and the material is held in a high pressure tank for storage.

U.S. Pat. No. 5,649,517 issued on Jul. 22, 1997 to Poola, et al, deals with an air separating membrane in a variable oxygen/nitrogen enriched intake air system for internal combustion engine applications. Oxygen is put into the intake and nitrogen is input into the exhaust.

U.S. Pat. No. 5,672,187 issued on Sep. 30, 1997 to Rock et al, deals with a system and process for fuel which includes a plurality of vortex stacks of sequential vortex elements based on fuel inputs or conditions operationally coupled with an integrated pre-manifold centrifuge type-cyclone scrubber.

U.S. Pat. No. 5,746,188 Issued May 5, 1998 to Cooke deals with an apparatus for heating and vaporizing a liquid hydrocarbon fuel supplied to an internal combustion engine. The device is a baffled housing and the fuel is heated to promote vaporization. In one embodiment, exhaust may be introduced into the interior of the housing and mixed with the vaporized and heated fuel.

U.S. Pat. No. 5,871,000 issued Feb. 16, 1939 to Ratner deals with creating turbulence within a housing and using metallic materials to reduce the density of the fuel and thereby increasing fuel burn efficiency.

U.S. Pat. No. 5,881,702 issued on Mar. 15, 1999 to Arkfeld deals with a catalyzed fuel wherein there is a housing and contained within the housing, metals that are catalytic.

U.S. Pat. No. 6,026,787, issued Feb. 22, 2000 to Sun, et al deals with a mixture of gaseous fuel such as propane and/or natural gas. Controllers and regulators are used to signal the fuel feed depending on the vehicle's exhaust oxygen sensors.

U.S. Pat. No. 6,045,772 issued Apr. 4, 2000 to Szydlowski deals with a fuel atomizer that vaporizes both fuel and steam for injection into a fuel reformer.

U.S. Pat. No. 6,174,160 issued Jan. 16, 2001 to Lee, et al, deals with a method and apparatus to pre-vaporize and premix liquid and or gaseous fuels with air in two stages at two different temperatures prior to combustion.

U.S. Pat. No. 6,139,518 issued Feb. 20, 2011 to Cooke, deals with an apparatus for heating and vaporizing a liquid hydrocarbon fuel supplied to an internal combustion engine. A venturi shaped inner sleeve of the apparatus is heated to promote vaporization of the liquid hydrocarbon fuel injected into the interior of the housing.

U.S. Pat. No. 6,314,915, issued Nov. 13, 2001 to Pugachev deals with an apparatus that allegedly pulverizes and makes the fuel gaseous for use in an internal combustion engine.

U.S. Pat. No. 6,327,860 issued Dec. 11, 2001 to Critchley deals with a premix fuel injector for use in gas turbine engines and combustion systems. The injector has a premix chamber having an inlet for receiving a flow of pressurized air and having an exit. A venture is coupled to the exit of the premix chamber.

U.S. Pat. No. 6,539,721 issued Apr. 1, 2003 to Oikawa et al deals with a fuel and gas mixer for a gas turbine combustors and includes a conical annulus communicating with a smaller end of a downstream truncated conical chamber.

U.S. Pat. No. 6,968,692 issued Nov. 29, 2005 to Chin et al, deals with a fuel/air premising module for gas turbine engines. It uses a plurality of fixed swirler vanes to do the mixing.

U.S. Pat. No. 6,769,421 issued Aug. 3, 2004 to Newhouse et al, deals with a vaporization system for liquid hydrocarbon fuel in a closed system prior to entry into an internal combustion engine. The fuel is heated to boiling, but not to the vapor stage, to prevent flash point problems.

U.S. Pat. No. 7,980,230 issued Jul. 19, 2011 and U.S. Pat. No. 8,020,537 that issued Sep. 20, 2011 to Smart deal with a fuel vaporizer for an internal combustion engine having a closed pressure chamber defining a volume, to be heated, and a liquid fuel supply system disposed to emit a liquid fuel spray. It is a closed pressure chamber system.

U.S. Pat. No. 8,074,895 that issued Dec. 13, 2011 to Mao, et al deals with a fuel injection system requiring a piezo-electric injector for delivering atomized fuel to an engine.

U.S. Pat. No. 8,266,911 issued Sep. 18, 2012 to Evulet deals with a premixing device including an air inlet configured to introduce compressed air into a mixing chamber.

U.S. Pat. No. 8,464,694 issued Jun. 18, 2013 deals with a system and method for providing fuel to internal combustion engines including fuel activation prior to injection. It includes exhaust gas recirculation which can be easily added to existing diesel and gasoline engine fuel supply systems.

U.S. Pat. No. 8,495,990 issued Jul. 30, 2013 to Rivera et al deals with a pre-injection fuel atomization system for a combustion engines that reduces droplet size of incoming fuel at the air intake creating an aerosol. It uses a vibrating crystal in a transducer for this activity.

It was determined by the inventors herein that none of the prior art set forth Supra anticipates or makes the instant invention obvious.

THE INVENTION

What is described and claimed herein is a mechanically induced vacuum driven delivery system for providing pre-vaporized fuel to an internal combustion engine. The delivery system comprises in combination a dual cyclonic air/fuel mixing vortex and acceleration chamber having a top opening, a first end opening, and a second end opening opposite said first end opening.

The first opening contains in it, a first push-lock connector, and the second opening contains a secondary laminar flow converter surmounted by a second push-lock connector. The top opening contains a third push-lock connector, the third push-lock connector being surmounted by and connected to an electronically controlled regulator, said electronically controlled regulator having connected thereto, a pressure/heat relief vent. The electronically controlled regulator is also connected to a computer interface connection. The electronically controlled regulator is surmounted by a fuel line connection.

There is a push-lock connector attached to an open line to provide PCV airflow from an internal combustion engine. The second push-lock connector is attached to an open line to provide air and fuel flow outwardly toward an intake manifold of an internal combustion engine.

The third push-lock connector is surmounted by and connected to an electronic controlled regulator, the electronically controlled regulator having attached thereto a pressure/heat relief valve, venting to the atmosphere.

The third push-lock connector is connected to a computer interface connection that is connected to a computer, the computer not being part of this invention. The top of the electronically controlled regulator is openly connected to a fuel line that provides fuel to the electronically controlled regulator. Finally, there is a secondary laminar flow converter, the secondary laminar flow converter having an internal configuration wherein one end of the secondary laminar flow converter internally, is smaller than an opposite end of the secondary laminar flow converter, internally. Computers and automobile engines are not considered part of this invention.

DETAILED DISCUSSION OF THE INVENTION

Figures 1A, 1B:
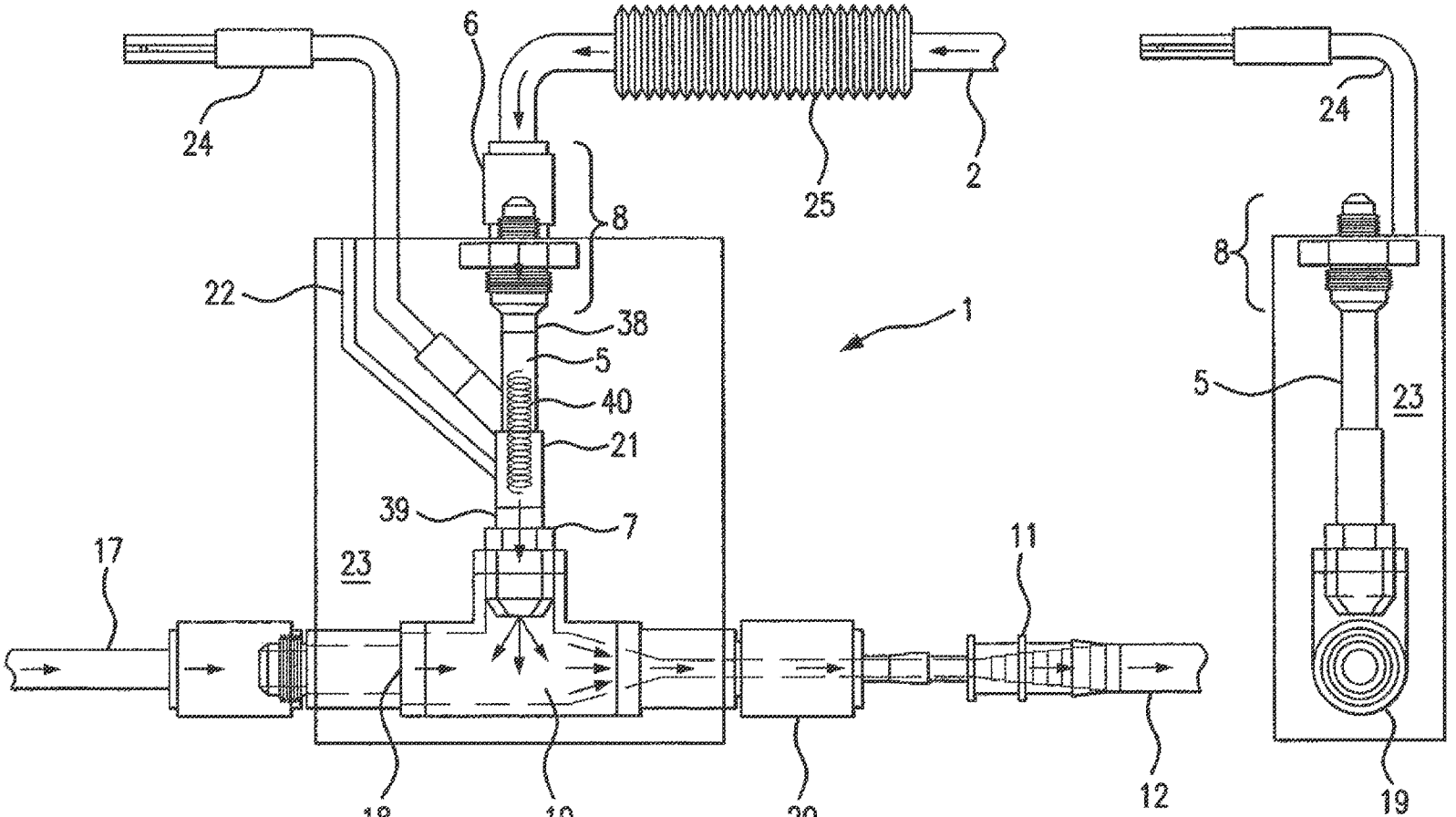
FIG. 1A illustrates a vapor assembly of this invention.
FIG. 1B is a full end view of the device of FIG. 1A.

A vapor assembly 1 of this invention is shown in FIG. 1A, wherein the vapor assembly 1 is structured to be positioned between a fuel supply line 2 of an internal combustion engine 3 (FIG. 4) and an automotive engine fuel combustion assembly 4 (FIG. 4), and including an elongate tubular housing 5 having an inlet end 6, an outlet end 7, and a flow-through passageway extending therebetween. The flow-through passageway is an electronically controlled regulator 21 comprising a top valve 38 and a bottom valve 39 and an electromagnetic induction coil 40, in phantom, therebetween. The inlet end 6 is coupled with the fuel supply line 2 so as to receive fuel flow therethrough into the flow-through passage, wherein a flow of the fuel is initiated and the fuel is influenced by a combination of known metallic catalysts used for these types of applications (See FIG. 4, designation 26) which chemically conditions the fuel flowing through the flow-through passage by weakening and the rearranging the molecular bonds of the fuel with a catalytic effect and separating the fuel particles into a plurality of subatomic particles, thereby reducing the density of the fuel and substantially increasing the fuel burn efficiency. Further, the outlet end 7 of the housing 5 is coupled with a coupling 8 directly with the fuel combustion assembly so as to provide for the flow of conditioned fuel therebetween without a substantial risk of diminishing the effects of the conditioning.

The vapor assembly 1 as shown in FIG. 1A also shows a PCV inlet 17 connecting to a first opening 18 of a dual cyclonic air/fuel mixing vortex and acceleration chamber 19 and a second opening 20 wherein there is coupled thereto, a secondary laminar flow converter 11. There is an electronically controlled regulator 21 for the fuel along with a pressure/heat relief vent 22 from the regulator 21 to the outside of the enclosure 23. A computer interface connection 24 connects housing 5 with a computer (computer not part of the invention). Optionally, one may couple a fuel heater 25 to the incoming fuel line 2, if desired. The enclosure 23 can be a regular six-sided housing, including a top, a bottom, two side, and two ends, made of metal, or it can be can an encapsulation, for example, by epoxy resin, or the like.

The fuel enters through a coupling 8 creating a spinning column of fuel, which is enhanced and accelerated by an electromagnetic induction coil 40. Entrained fuel aerosol droplets are sheared and turbulently reduced by pressure differentials into a viscous vapor phase, and then into a gas-phase state. The spinning column containing turbulently vaporized fuel and any residual aerosols in the air mixture are then passed into and through a dual cyclonic air/fuel mixing vortex and acceleration chamber 19 and then on to the secondary laminar flow converter 11. This allows only the vaporized, homogenized and usually chemically stoichiometric, or leaner, (oxygen balanced) and combustion ready gas-phase fuel to exit the system at 12 to the intake manifold as shown in FIG. 4.

Figure 2:
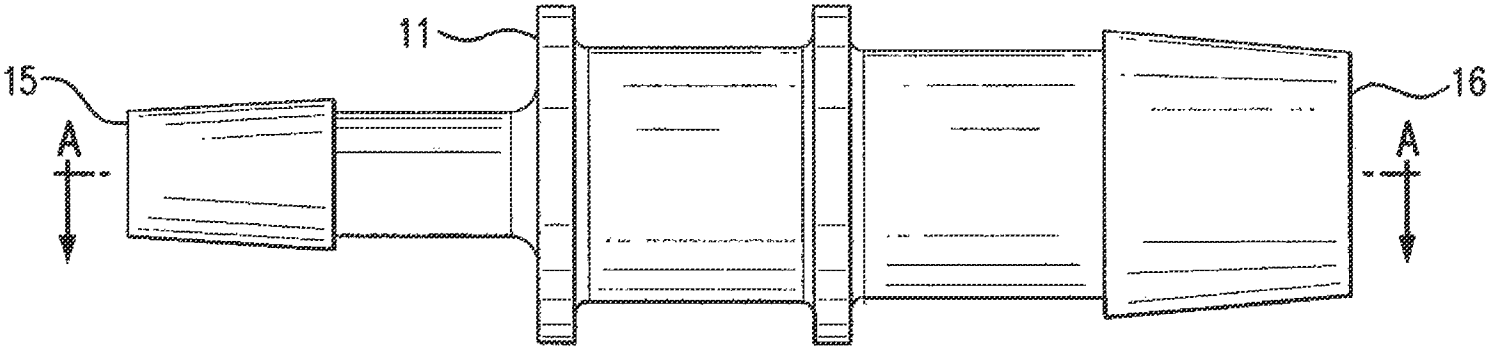
FIG. 2 a secondary laminar flow converter useful in this invention.
Figure 3:
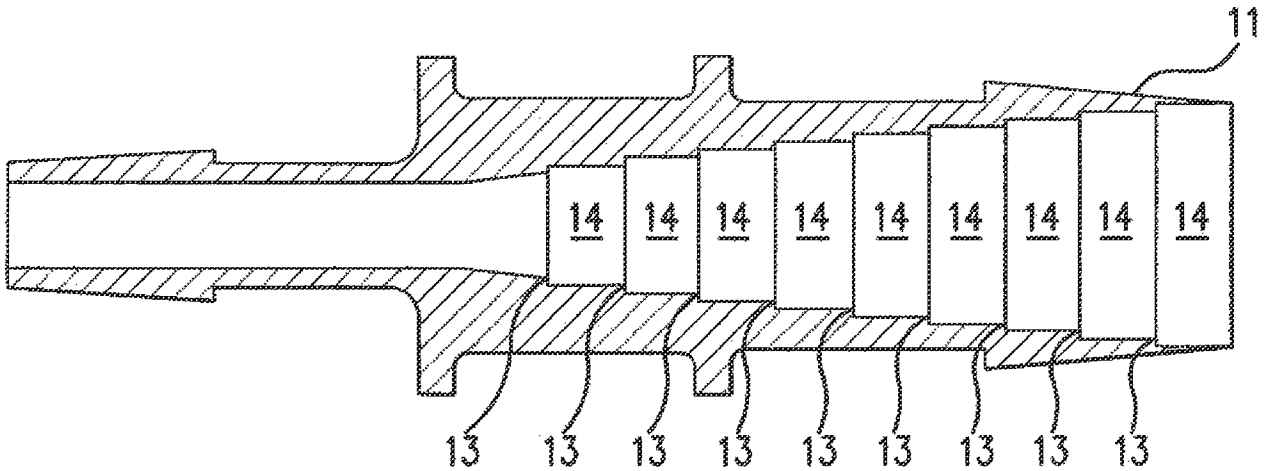
FIG. 3 is a cross sectional view of the secondary laminar flow converter through line A-A of FIG. 2.

The secondary laminar flow converter 11 shown in FIG. 2 and again shown in FIG. 3, which is a cross sectional view of the device of FIG. 2 along lines A-A, shows the internal configuration of the secondary laminar flow converter 11.

The secondary laminar flow converter 11 of this invention is a specifically designed multiple tiered secondary laminar flow converter containing a plurality of separate pressure (high and low) differentials further promoting turbulence accelerating the evaporation process, having an inlet end 15 and an outlet end 16. As shown in FIG. 3, the interior of the secondary laminar flow converter 11 is shown wherein each level has a ridge 13 to it. The ridges create a high pressure area followed immediately by a low pressure area 14. Each time the fuel moves past a ridge 13, the fuel is accelerated and the vaporization process is accelerated due to shear speed and expansion and turbulence. High pressure condensed material, if speeded up and moved into a low pressure area, creates vapor. The ridges 13 are sequentially tapered down to enhance the speed of the fuel.

Figure 4:
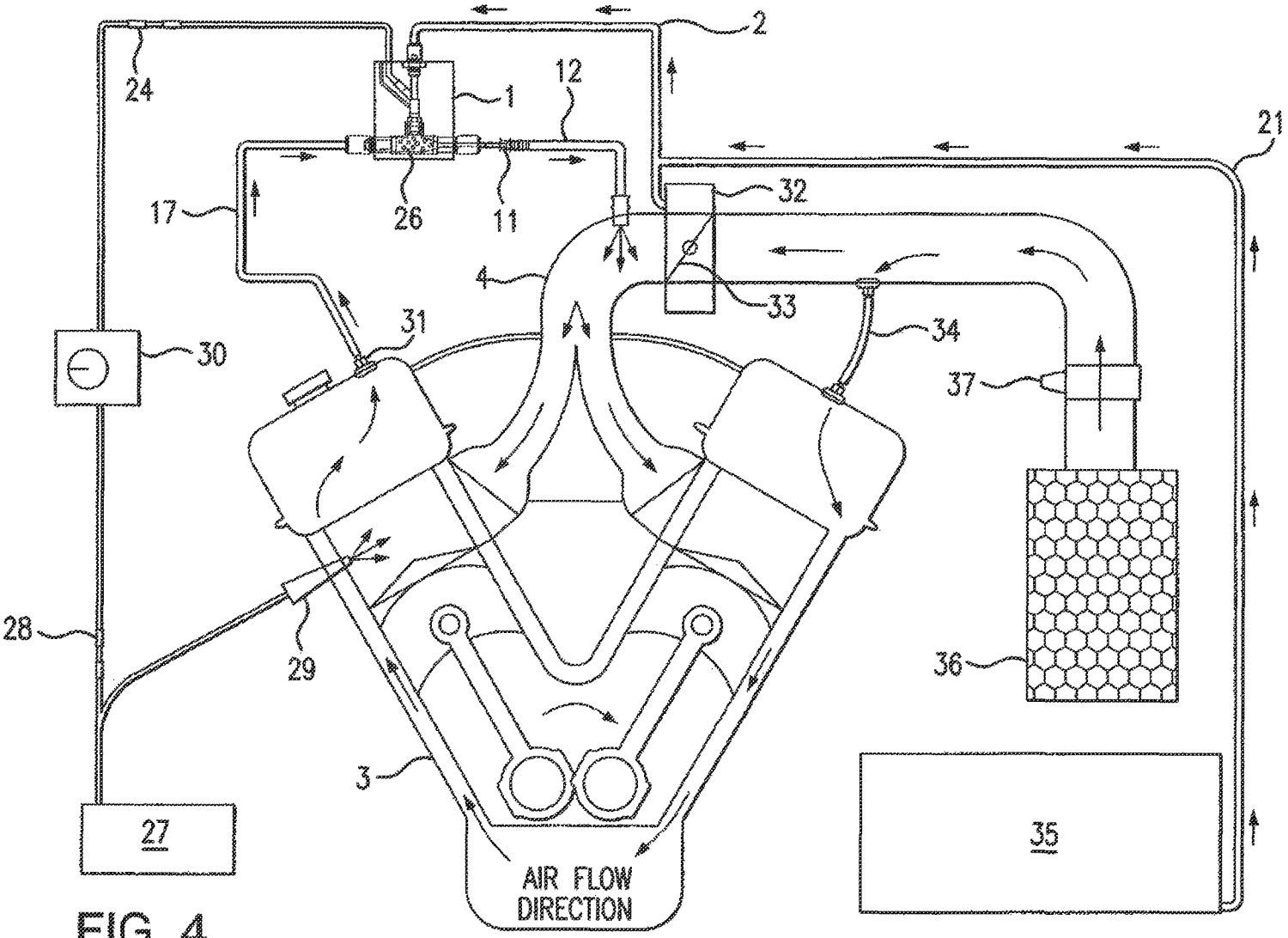
FIG. 4 is a schematic of the vapor assembly of this invention in conjunction with an internal combustion engine.

FIG. 4 is a schematic of the vapor assembly 1 of this invention in conjunction with an internal combustion engine 3. There is shown various other elements of an automotive system, which are not considered part of this invention but are necessary to disclosure for a complete understanding of this invention. There is an engine control unit 27 (ECU) which is connected to all injectors whereby controlling fuel delivered to the combustion chambers. Each fuel injector supplies the necessary fuel as required by the injectors which are in turn commanded by the ECU as to how much fuel to inject at any given moment based upon various load demands which are calculated using the data acquired from the various engine sensors. Also shown is a wire harness 28 to all engine stock fuel injectors 29. The harness 28 leads to a control module 30 which leads eventually to the assembly 1 of this invention. The schematic engine shows a crankcase ventilation valve 31 which leads to the assembly 1. In addition, there Is shown a throttle body 32 and a throttle plate 33 along with a fresh air intake to the crankcase 34. Designation 12 shows the air/fuel flow outlet to the intake manifold.

In addition, and not part of the invention, there is shown a fuel tank 35, an air filter 36, a mass air flow sensor and computer interface connection port 37.

The computer interface on the vehicle maintains primary control over the vaporizer. The ECU commands the vaporizer when to vaporize the fuel and when not to, based upon various load, speed, throttle position and other various sensor data. The vaporizer control module allows for finer adjustments of the vaporizer. This controller assists the ECU with fine tuning calibrations.

The major problems associated with an internal combustion engines using a mixture of liquid hydrocarbon fuel and liquid aerosol droplets are inefficiently performing engines, and air pollution caused by inefficiently performing engines operating at pollution-generating high combustion temperatures.

Fuels prepared by this system have the advantage of dramatically improving engine performance while decreasing all known polluting emissions.

Only Vaporized fuel will burn cleanly. The instant vaporization system allows efficient combustion of all applicable fuels by stoichiometrically pre-conditioning the fuel and air mixture prior to the entry thereof into the engine. The fuel is transformed into a stable (chemically fixed), homogeneous, stoichiometric, oxygen balanced, vaporous gas-phase state. This promotes an improved distribution of the fuel-air mixture to each of the cylinders, a much improved combustibility of the fuel/air mixture, and results in an efficient use of the inherent chemical energy within the fuel. More of this chemical fuel energy is converted to work than has ever before been possible by converting into thermal energy, and then, into kinetic energy, thereby reducing inherent losses of the conversion.

Moreover, combustion temperatures remain at levels less than the threshold temperature above which Nitrogen and Oxygen combine during luminous flame combustion to form NOx (at approx. 2800.degree. F.). Further, the "heavy ends" of the fuel containing wax/gum elements often are the nucleus for the very large aerosol droplet deposits. The vaporization system separates and reduces the larger droplets until they are reduced to a vaporous gas-phase air/fuel mixture, which goes into the engine and is oxidized along with the more volatile fractions of the fuel.

The use of vaporized fuel substantially increases the typical "flame front" of combustion inside the engine's combustion chamber. The results are unique improvements in all relevant combustion and emission parameters. There is virtually no "knock", detonation, or premature detonation, when operating an engine with fuel processed by the vaporization system with either the compression ratios ranging from 8 to 12:1 found in the majority of conventional engines or even with any mechanically attainable higher compression ratios of 20:1 or above. Thus it is possible to operate an engine in its original equipment configuration, or to optimize the BMEP (brake mean effective pressure) by altering the compression ratio, valve timing, and ignition occurrence (timing) to achieve maximum fuel economy and minimum emissions and maximum power. The stock, the 20:1 plus compression ratio, or supercharged engine configurations will produce operating conditions providing greatly reduced (or eliminated) emissions of carbon, UHC (uncombusted hydrocarbons), CO, aldehydes, and NOx (oxides of nitrogen).

Moreover, the luminous heat front of combustion which occurs with current internal combustion engines also requires that the spark must start many degrees prior to piston's top dead center to allow for "slow" combustion (propagation) without detonation while still enabling reasonable engine power output.

Gasoline that is prepared via vaporization has the advantage of combusting without any detonation and with other unique beneficial characteristics such as lower temperature, less NOx, less CO and UHC, where maximum cylinder pressure develops much more rapidly allowing spark-fuel ignition to occur much nearer top dead center. This focuses more of the available expansion pressure from combustion into usable torque and power.

In addition, the luminous heat front produces large amounts of radiant and other forms of energy which must then be absorbed by the engine structure and dispersed by the cooling system. A large percentage of fuel energy is lost through radiated energy. However, Vaporized fuel oxidizes without many of these losses through non-luminous-"blue flame," "cold" combustion.

Further, pre-vaporized fuels should have the benefit of extending engine life. The reduction of carbonaceous particulate matter/soot and possibly organic acids resulting from the incomplete or inefficient combustion will provide the advantage of reducing engine wear. Reduced engine wear can therefore be added to improved fuel economy and increased engine efficiency with the attendant pollution reduction as the real advantages of the inventive fuel system technology.

Pre-vaporization of hydrocarbon fuel prior to combustion significantly reduces the "hot spots" inside of the engine caused by "fuel droplets" (i.e. the Aerosol from the engines injectors) combustion, thus promoting cleaner combustion resulting in a reduction of emission, without the need to add water or steam to keep emissions low, in addition to more power due to the faster burn rate of the vapor. Also, due to the faster burn rate of the fuel, the time constant (Flame front) is also significantly increased, this means that the faster the flame front caused by less liquid and more vapor which burns faster inside the combustion chamber, the time constant or duration of that burn is significantly reduced, i.e. less burn time while simultaneously burning more of it equals less hydrocarbons available to blow past the rings and valves getting into the oil and creating a sand paper effect wearing down the parts. The end result, less wear and tear on the engine parts, thus, their longevity increases as quickly, (i.e. the parts last longer and the oil stays cleaner for a longer period of time) additionally reducing wear and tear on the parts.

Devices of this invention were tested on various automobiles with the following results shown on TABLE I:

TABLE I

| type of vehicle Year, Make, Model | engine size | MPG Before | MPG After | % gain |
|---|---|---|---|---|
| 2012 Chevy Cruz | 1.4 L 4 Cyl. | 32.7 | 53.4 | 63 |
| 2005 Chevy Silverado | 8.1 L | 5.3 | 10.77 | 103 |
| 2002 Ford Explorer | 4.0 L | 12.5 | 17.6 | 30 |
| 2010 Lincoln | 3.4 L | 10.2 | 23.4 | 108 |
| 1991 Ford Festiva | 1.4 L | 30.0 | 40.0 | 33 |
| 2002 Pontiac Montana | 3.4 L V6 | 22.8 | 29.5 | 29 |
| 2005 Ford Explorer | 3.0 L V6 | 10.5 | 12.0 | 22 |
| 2004 Nissan titan | 5.6 L V8 | 17.5 | 28.5 | 44 |
| 2002 Ford Excursion | 6.8 L V10 | 10.5 | 14.5 | 40 |
| 2012 Toyota Prius | 1.8 L 4 Cyl. | 48.0 | 70.0 | 45 |
| 2006 Buick La Cross | 3.8 L V6 | 23.0 | 31.0 | 35 |
| 2008 Jeep Patriot | 2.4 L 4 Cyl. | 18.0 | 24.6 | 36 |
| 2007 Toyota Camry | 2.2 L 4 Cyl. | 28.0 | 33.6 | 20 |
| 2009 Chrysler Van | 3.6 L V6 | 23.0 | 31.0 | 34 |
| 2010 Chrysler | 3.6 L V6 | 21.0 | 31.0 | 47 |
| 2011 Chrysler | 3.6 L V6 | 23.0 | 31.0 | 34 |

TABLE I-continued

| type of vehicle Year, Make, Model | engine size | MPG Before | MPG After | % gain |
|---|---|---|---|---|
| 2004 Toyota Camry | 2.0 L 4 Cyl. | 32.0 | 44.0 | 37 |
| 2004 GMC crew cab | 8.1 L V8 | 10.0 | 13.6 | 36 |
| 2002 dodge 1500 | 318 V8 | 11.0 | 15.0 | 36 |
| 2012 GMC Sierra | V8 | 16.0 | 22.0 | 31 |
| 1992 Grand Marquis | 4.6 L V6 | 17.0 | 28.0 | 64 |
| 1998 Dodge P/U | 318 V8 | 12.0 | 18.0 | 50 |
| 2010 Toyota Tundra | V8 | 19.0 | 24.0 | 27 |
| 2008 Ford Taurus | 3.5 L V6 | 29.0 | 34.0 | 24 |
| 2009 Ford P/U | V8 | 19.0 | 24.0 | 22 |

What is claimed is:

1. A mechanically induced vacuum driven delivery system for providing pre-vaporized fuel to an internal combustion engine, said delivery system comprising in combination:

A. a dual cyclonic air/fuel mixing vortex and acceleration chamber having a top opening, a first end opening, and a second end opening opposite said first end opening, said dual cyclonic air/fuel mixing vortex and acceleration chamber containing therein a mesh metal catalyst; said first end opening containing therein, a first push-lock connector, said second end opening containing therein a secondary laminar flow converter connected to a second push-lock connector, said top opening containing therein a third push-lock connector, said third push-lock connector being connected to B. an electronically controlled regulator, said electronically controlled regulator containing therein, a top valve, a bottom valve and an electromagnetic induction coil there-between and having connected thereto, C. a high speed shearing chamber comprising an outlet port having a predetermined cross-sectional opening in an entry port and a smaller cross-sectional opening in an exit port, said high speed shearing chamber exit port being flow-through connected to said secondary laminar flow converter;

D. a pressure/heat relief vent;
said electronically controlled regulator being connected to E. a computer interface connection and said electronically controlled regulator being connected to F. a fuel line connection, wherein said first push-lock connector is attached to an open line to provide PCV airflow from an internal combustion engine; said second push-lock connector being attached to an open line to provide air and, fuel flow outwardly to an intake manifold of an internal combustion engine; said third push-lock connector being connected to the electronically controlled regulator, said electronically controlled regulator having attached thereto a pressure/heat relief valve, venting to the atmosphere; said third push-lock, connector being connected to a computer interface connection that is connected to a computer; a top of said electronically controlled regulator being openly connected to a fuel line that provides fuel to the electronically controlled regulator.

* * * * *